US009352377B2

(12) United States Patent
Smeyers et al.

(10) Patent No.: US 9,352,377 B2
(45) Date of Patent: May 31, 2016

(54) METHOD OF JOINING ALUMINIUM ALLOY SHEETS OF THE AA7000-SERIES

(75) Inventors: Axel Alexander Maria Smeyers, Heist op den Berg (BE); Sunil Khosla, Beverwijk (NL)

(73) Assignee: ALERIS ALUMINUM DUFFEL BVBA, Duffel (BE)

( * ) Notice: Subject to any disclaimer, the term of this patent is extended or adjusted under 35 U.S.C. 154(b) by 128 days.

(21) Appl. No.: 14/241,683

(22) PCT Filed: Sep. 10, 2012

(86) PCT No.: PCT/EP2012/067627

§ 371 (c)(1), (2), (4) Date: Jun. 2, 2014

(87) PCT Pub. No.: WO2013/041396

PCT Pub. Date: Mar. 28, 2013

(65) Prior Publication Data

US 2014/0290064 A1 Oct. 2, 2014

(30) Foreign Application Priority Data

Sep. 20, 2011 (EP) ..... 11182019
Oct. 7, 2011 (EP) ..... 11184274

(51) Int. Cl.
*B21D 39/03* (2006.01)
*B21D 39/02* (2006.01)
(Continued)

(52) U.S. Cl.
CPC ..... *B21D 39/031* (2013.01); *B21D 39/02* (2013.01); *B21D 39/03* (2013.01); *B21J 15/02* (2013.01);
(Continued)

(58) Field of Classification Search
CPC ..... B21D 39/02; B21D 39/03; B21D 39/031; C22F 1/04; C22F 1/053; B21J 15/02; B21J 15/025; B21J 15/08; C21D 9/50; Y10T 29/49936; Y10T 29/49943; Y10T 29/49945; Y10T 29/499454; Y10T 29/49622; Y10T 29/49908
USPC ..... 29/521, 524.1, 525.01, 525.03, 525.05, 29/525.06, 505
See application file for complete search history.

(56) References Cited

U.S. PATENT DOCUMENTS 3,856,584 A * 12/1974 Cina ..... C22F 1/053 148/417
5,948,185 A * 9/1999 Krajewski ..... B21D 39/02 148/415
(Continued)

FOREIGN PATENT DOCUMENTS

BE 102009055010 * 6/2011 ..... B62D 25/06
DE 914922 C * 7/1954 ..... B21J 15/025
(Continued)

OTHER PUBLICATIONS

International Search Report mailed Jan. 4, 2013 for International Patent Application No. PCT/EP2012/067627 having an International filing date of Sep. 10, 2012.
(Continued)

*Primary Examiner* — Moshe Wilensky
*Assistant Examiner* — Bayan Salone
(74) *Attorney, Agent, or Firm* — Vorys, Sater, Seymour and Pease LLP

(57) ABSTRACT

A method for producing a joint in at least two overlapping metal work pieces using a joining tool to obtain a mechanical joint between the overlapping work pieces, in particular joining by mechanical folding or pressure joining At least one of the first work piece and second work piece is a sheet material made of an aluminum alloy of the AA7000-series. A heat-treatment is applied to at least the work piece of 7000-series sheet material within 120 minutes prior to the production of the joint and/or for at least part of the time during production of the joint to temporarily reduce the tensile strength in the joining area of at least the work piece of said 7000-series sheet material.

25 Claims, 8 Drawing Sheets

Figure 1:
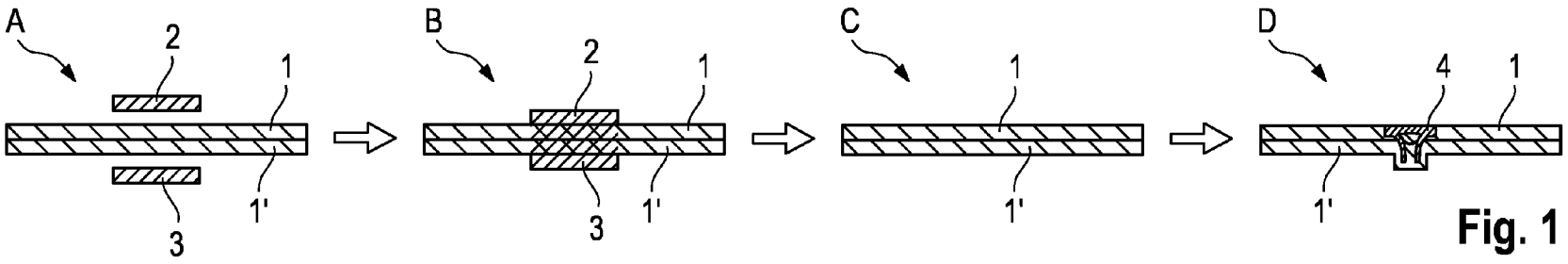

(51) Int. Cl.

| | |
|---|---|
| ***B21J 15/02*** | (2006.01) |
| ***C21D 9/50*** | (2006.01) |
| ***C22F 1/04*** | (2006.01) |
| ***C22F 1/05*** | (2006.01) |
| ***B21J 15/08*** | (2006.01) |
| ***C22F 1/053*** | (2006.01) |

(52) U.S. Cl.
CPC ..... *B21J 15/025* (2013.01); *B21J 15/08* (2013.01); *C21D 9/50* (2013.01); *C22F 1/04* (2013.01); *C22F 1/053* (2013.01); *Y10T 29/4995* (2015.01); *Y10T 29/49622* (2015.01); *Y10T 29/49908* (2015.01); *Y10T 29/49936* (2015.01); *Y10T 29/49943* (2015.01); *Y10T 29/49947* (2015.01); *Y10T 29/49954* (2015.01)

(56) References Cited

U.S. PATENT DOCUMENTS

| | | | | |
|---|---|---|---|---|
| 8,409,725 | B2 * | 4/2013 | Hashimura | B21J 15/025 428/594 |
| 2003/0167621 | A1 * | 9/2003 | Wang | B21J 15/025 29/525.06 |
| 2004/0134573 | A1 * | 7/2004 | Joaquin | B21D 26/023 148/639 |
| 2010/0098969 | A1 * | 4/2010 | Hashimura | B21J 15/025 428/653 |

FOREIGN PATENT DOCUMENTS

| | | | | |
|---|---|---|---|---|
| DE | 102009055010 | A1 | 6/2011 | |
| EP | 1440747 | A2 * | 7/2004 | B21D 26/023 |
| EP | 2128004 | A1 | 12/2009 | |
| JP | 2007039003 | A * | 2/2007 | B60J 5/00 |
| JP | 2128004 | A1 * | 12/2009 | B21J 15/025 |
| WO | 9850595 | A1 | 11/1998 | |
| WO | WO 9850595 | A1 * | 11/1998 | B21D 39/02 |

OTHER PUBLICATIONS

International Preliminary Report on Patentability of Mar. 25, 2014 for PCT International Application No. PCT/EP2012/067627, International Filing Date Sep. 10, 2012.

* cited by examiner

METHOD OF JOINING ALUMINIUM ALLOY SHEETS OF THE AA7000-SERIES

CROSS-REFERENCE TO RELATED APPLICATIONS

This is a §371 National Stage Application of International Application No. PCT/EP2012/067627 filed on 10 Sep. 2012, claiming the priority of European Patent Application No. 11182019.7 filed on 20 Sep. 2011 and European Patent Application No. 11184274.6 filed on 7 Oct. 2011.

FIELD OF THE INVENTION

The invention relates to a method for joining components together and more particularly to joining aluminium alloy sheets of the AA7000-series via techniques like hemming, clinching and riveting.

BACKGROUND TO THE INVENTION

As will be appreciated herein below, except as otherwise indicated, aluminium alloy designations and temper designations refer to the Aluminium Association designations in Aluminium Standards and Data and the Registration Records, as published by the Aluminium Association in 2011 and are well known to the person skilled in the art.

For any description of alloy compositions or preferred alloy compositions, all references to percentages are by weight percent unless otherwise indicated. The term "up to" and "up to about", as employed herein, explicitly includes, but is not limited to, the possibility of zero weight-percent of the particular alloying component to which it refers. For example, up to about 0.2% Ti may include an alloy having no Ti.

Self-piercing riveting ("SPR") is a well-established technique for joining together components such as, for example, sheet metal. A self-piercing rivet typically comprises a head and a partially hollow cylindrical shank that terminates in an annular piercing edge and is inserted into one or more sheets of material. The rivet is driven by a punch of a setting tool into the sheets such that the shank pierces through the upper sheet (or sheets) and flares outwardly whilst supported by a die. It is inserted without full penetration such that the deformed end of the rivet remains encapsulated by an upset annulus of the material thus forming a mechanical interlock. Self-piercing riveting enables sheet material to be joined without the requirement for the pre-drilling or pre-punching of a hole in the material.

Self-piercing riveting technology has application in many manufacturing industries but has been particularly successful in the automotive industry where there is a drive to use material of lighter weight without reducing safety. SPR has been used to join components such as aluminium vehicle body panels, which cannot be spot-welded easily. SPR techniques have proven to be successful in this context not only because they produce joints of good strength and fatigue properties that can be easily automated on a production line but also because the joints are aesthetically acceptable in that there is little distortion of the upper surface of the sheet material around the rivet.

Riveting, and SPR in particular, is faced with increasing challenges in terms of the types of joints that manufacturers would like to produce using this technology, in particular when using high-strength aluminium series alloys such as those of the AA7000-series alloys.

DESCRIPTION OF THE INVENTION

It is an object of the invention to provide an improved method of joining that can be applied to high-strength aluminium alloy sheet material.

It is another object of the invention to provide an improved method of mechanical joining that can be applied to high-strength aluminium alloy sheet material.

These and other objects and further advantages are met or exceeded by the present invention and provided is a method for producing a joint in at least two overlapping metal work pieces using a joining tool to obtain a mechanical joint between overlapping work pieces, in particular by means of local mechanical folding (e.g. hemming or bending) or by pressure-joining (e.g. riveting or clinching), and wherein at least one of the first work piece and second work piece is a sheet material made of an aluminium alloy of the AA7000-series, and wherein there is applied a heat-treatment to at least the work piece of said 7000-series sheet material within 120 minutes prior to the production of the joint and/or for at least part of the time during production of the joint so as to temporarily reduce the tensile strength in the joining area of at least of the work piece of said 7000-series sheet material.

The heat-treatment to temporarily reduce the tensile strength of the 7000-series sheet material in at least the joining area can be carried out prior to the joining operation, for example joining by means of hemming, clinching or riveting, by heat-treating the whole of the 7000-series sheet material or by at least heat-treating the specific areas to be joined (e.g. a flange area) or a circular area with a diameter somewhat larger as the diameter of the rivet. The heat-treatment can also be done by carrying out a local heat-treatment in the joining area at the beginning of the joining operation, and can be carried out as part of the joining operation itself.

Preferably the heat-treatment is carried out in such a way that at least the joining area of the 7000-series sheet material is subjected to a temperature in a range of about 100° C. to about 350° C. A preferred lower-limit is about 140° C. or 160° C. A preferred upper-limit for the temperature is about 250° C., more preferably about 230° C. The most preferred range is from 175° C. to 220° C., for example 195° C.

The heat-treatment at the defined temperature range is preferably carried out for not longer than in total about 60 seconds, and preferably for not longer than in total about 30 seconds, and more preferably for not longer than in total about 20 or 12 seconds, for example about 2 sec. or about 5 sec. The minimum holding time on temperature is very short, e.g. 0.01 sec, preferably about 1 or 2 seconds, to ensure that the sheet material has reached the targeted heat-treatment temperature.

In preferred embodiments, the heat-up time to reach the heat treatment temperature is between 0.5 and 10 seconds, preferably between 1 and 5 seconds.

Unlike prior art heat-treatments, such as disclosed in WO 98/50595 A1, the inventive heat treatment does not require a forced cooling or quenching operation, such as water quenching, at the end of the heat treatment to (temporarily) reduce the tensile strength or to safeguard final strength. Such operations are at present not excluded, but treatments without forced cooling are preferred. At most, the heat treated sheet material may be subjected to an air jet, but in most embodiments cooling by the ambient air will suffice. In some embodiments, the work pieces are still at an elevated temperature, e.g. above 80° C., when the mechanical joint is produced.

In an embodiment of the invention the method is applied to join two overlapping metal work pieces to obtain a joint by means of pressure-joining. In particular two pressure-joining techniques are important for the present invention.

In one important embodiment the pressure-joining is obtained by means of clinching. Clinching concerns a method of joining metal sheets by localised forming of the materials and produces an interlocking joint between two or more layers of material. The resulting clinch can be round or rectangular depending on the joining tool used. A round clinched joint is preferred, and preferably without pre-cutting through the material. Forming the clinch joint can be done up to 120 minutes after applying a heat treatment at a temperature less than 350° C. on the joining area of at least one 7000-series metal sheet or while applying the heat treatment.

Commonly the clinch joint is formed due to an interaction of a die and a punch.

In another important embodiment of the invention the pressure-joining is obtained via mechanical fasteners, more in particular by using a rivet.

Also a recent developed joining technique combining both clinching and riveting can be used in the method according to this invention. In the German language this technique is also called "Nietclinchen".

In another embodiment of the method according to the invention, the method employs mechanical folding, in particular bending or hemming, to join at least two overlapping metal work pieces. Hemming is a technique well-known in the art whereby a substantially linear joint is formed by plastically folding one work piece of sheet metal over or around another to create an immovable seam.

Each of these joining techniques, in particular riveting, can also be combined with adhesive bonding.

In accordance with the invention it has been found that the method enables the production of a mechanical joint incorporating at least one work piece made of a 7000-series material and providing a crack-free joint. And the forces required to make such a mechanical joint by means of pressure-joining, e.g. clinching or riveting, are significantly reduced. Another advantage is that there is provided a crack-free clinched joint or riveted joint with a reproducible depth independent of the natural aging time of the 7000-series material before the joining operation. Furthermore, the strength of the joint is enhanced.

When producing on an industrial scale, e.g. at an OEM, it is not feasible, due to logistical constrains, to ensure that components, incorporating at least one member or work piece of a 7000-series material that was deep drawn in a W-temper (solution heat-treated, quenched), are joined within a limited or predefined narrow time frame. As a direct consequence, different members or work pieces of a 7000-series material can have been subjected to a different duration of natural aging and consequently will have different levels of strength and ductility. For several 7000-series aluminium alloys having been natural aged for more than 2 to 3 weeks, the ductility is reduced significantly. As a consequence, it becomes very difficult to produce mechanical joints, e.g. via hemming, clinching or riveting, without cracks in the sheet material. Furthermore, due to the difficulty of tracking the "age" of individual 7000-series parts to be joined, it may happen that two members or work pieces with different levels or different history of natural aging have to be joined, thereby it is practically impossible to know in advance which force to apply during joining to achieve a pressure-joint, e.g. clinched or riveted, with the desired and reproducible penetrating depth.

It has been found that a heat-treatment within the defined range, and with preferred narrower ranges, temporarily reduces the yield strength of the AA7000-series alloy material and correspondingly increases the ductility. This reduction is substantially independent of the amount of natural aging it had received prior to the heat-treatment in accordance with the invention, and bringing it again to a desirable, reproducible and relatively low level as it had at the time immediately up to 60 minutes after having been solution heat treated and quenched.

As a resultant, it allows the AA7000-series material to be joined without the formation of cracks during hemming or pressure-joining in particular via clinching or riveting. Furthermore, it allows a consistent and reproducible clinching and riveting practice with regard to joint quality (e.g. depth) and joining set-up (e.g. force). And by reducing the yield strength of the AA7000-series material in the joining area, lower levels of residual stresses are generated in the material by the joining operation. As a consequence, the occurrence of delayed fracture is prevented or at least postponed.

In addition, it has also been found that the method in accordance to this invention does not adversely affect the final strength properties of the AA7000-series material after being subjected to an artificial ageing treatment, such as a paint-bake cycle, in comparison to the same AA7000-series material in the T4 condition and subjected to the same artificial ageing treatment. For some embodiments it has been found that for the mechanical joint made, in particular via clinching or riveting, in accordance with the invention the tear strength and in particular the peel strength is increased compared to T4 sheet material.

A particular embodiment of the invention relates to a method for producing a joint in at least two overlapping metal work pieces using a joining tool comprising a punch to insert a rivet, more preferably a self-piecing rivet, into the work pieces to form the joint, the work pieces having a first surface that is nearest to the tool, the method comprising placing the work pieces between the tool and a die, and positioning a rivet between the punch and the first surface, using the punch to insert the rivet into the at least two overlapping work pieces such that the first surface is pierced by the rivet, and wherein at least one of the first work piece and second work piece is a sheet material made of an aluminium alloy of the AA7000-series, and wherein there is applied a heat-treatment to at least the work piece of said 7000-series sheet material within 120 minutes prior to the production of the joint and/or for at least part of the time during production of the joint so as to temporarily reduce the tensile strength in the joining area of at least of the work piece of said 7000-series sheet material.

In the embodiment of the method using riveting, the punch may apply a compressive force during rivet insertion to deform the work pieces into a joint at a joining area between the tool and the die.

In an embodiment of the method using riveting, at least two overlapping work pieces are joined which may comprise a first work piece that is closest to the punch and a second work piece that is closest to the die. There may be one or more intermediate work pieces between the first work piece and the second work piece. The rivet may pierce through at least a first work piece that is closest to the punch and may also pierce through one or more intermediate work pieces. The rivet is preferably inserted into the work pieces without full penetration (i.e. it does not pierce through the bottom work piece) such that a deformed end of the rivet remains encapsulated by an upset annulus of the material.

The rivet may have a head and a shank, which may be hollow or partially hollow. Alternatively it may take the form of a solid slug with or without a head. A combination of adhesive and rivet or clinch bonding may also be used.

The heat-treatment of at least the work piece made of an aluminium alloy of the AA7000-series in the joining area can be carried out using various heating means known to the skilled person, and include amongst others, induction heating, contact heating, ultrasonic heating and infra-red heating.

The heat-treatment may be applied to the whole work piece, or preferably only to the specific areas to be joined, which may be a flange area or a circular area with a diameter somewhat larger as the diameter of the rivet. In the case of pressure joining such as riveting and clinching, it is preferred that the heat treatment be applied locally to an area as little as possible. This may be achieved with e.g. induction heating. Of course, several such local areas on one work piece may be subjected to the heat-treatment one after the other or simultaneously, before the work piece is transferred to the joining tool.

Applying the heat treatment to only a limited area of the aluminium sheet(s) has the beneficial effect that no forced cooling is required. Due to the good thermal conductivity of aluminium, the heat generated in this limited area flows within a limited time into the surrounding area ensuring that the heated areas cools down very fast ensuring that the alloying elements don't get enough time to come out of solution. As a consequence, the heat treatment has no or only a negligible negative effect on the final strength.

Alternatively, if contact heating is used, the part (usually an outer rim) of the work piece where the joints are to be made can be selectively brought into contact with the hot plate(s) in order to apply a local heat treatment.

The heat-treatment may be applied to only one or to each of the overlapping work pieces simultaneously.

It is an important aspect in the method according to this invention that at least one of the work pieces is an AA7xxx-series aluminium alloy sheet material.

In another embodiment of the invention, one work piece is made from an AA7000-series aluminium alloy sheet material and the other work piece is also made from an aluminium alloy sheet material. This other work piece is preferably made from an aluminium alloy selected from the group of AA5000, AA6000 or AA7000-series aluminium alloys.

In another embodiment of the invention, one work piece is made from an AA7xxx-series aluminium alloy sheet material and the other work piece is made from a blank steel sheet or a steel sheet with one or more clad layers and/or one or more coatings.

The method according to this invention can be applied to a wide range of AA7000-series alloys, both for the first component as well as for the second component. In a preferred embodiment the aluminium alloy is selected from the group of AA7021, AA7136, AA7050, AA7055, AA7150, AA7075, AA7081, AA7181, AA7085, AA7185, and modifications thereof.

In another preferred embodiment, the AA7000-series alloy comprises, in wt.%,

Zn 3.8 to 8.2, preferably 5.0 to 7.0, most preferred 5.5 to 6.5,
Mg 1.5 to 2.3, preferably 1.5 to 2.1
Cu 0 to 0.45, preferably 0 to 0.3,
Zr 0.04 to 0.25
optionally one or two elements selected from the group consisting of Mn 0.05 to 0.5
Cr 0.05 to 0.5
Ti 0 to 0.15
Fe 0 to 0.35
Si 0 to 0.25,
other elements and unavoidable impurities, each maximum 0.05, total 0.20, balance aluminium.

In another embodiment, the AA7000-series alloy comprises, in wt. %,

Zn 3.8 to 8.2, preferably 5.0 to 7.0, most preferred 5.5 to 6.5,
Mg 1.5 to 2.3, preferably 1.5 to 2.1
Cu 0.6 to 2.4, preferably 1.2 to 2.4
Zr 0.04 to 0.25,
optionally one or two elements selected from the group consisting of:
Mn 0.05 to 0.50,
Cr 0.05 to 0.5,
Ti max. 0.15
Fe max. 0.35
Si max. 0.25,
other elements and unavoidable impurities, each maximum 0.05, total 0.20, balance aluminium.

Preferably the AA7000 series aluminium alloy sheet component has a gauge in a range of about 0.5 mm to 4 mm, and preferably of about 0.7 to 3.5 mm.

In an embodiment the AA7000-series aluminium alloy sheet component has been provided with a metal clad layer applied on at least one side, wherein the metal clad layer material has an inner-surface and an outer-surface and wherein the inner-surface is facing the AA7000-series material.

The clad layer or clad layers are usually much thinner than the core sheet, and each clad layer constituting about 1% to 25% of the total composite sheet thickness. A clad layer more typically constitutes around about 1% to 14% of the total composite sheet thickness.

The clad layer material can be made from an AA3000, AA4000-, AA5000-, AA6000-, or a different AA7000-series aluminium alloy compared to the core alloy. Typical examples of such clad layers are those having a chemical composition within the ranges of AA3004, AA3005, AA6016, AA6016A, AA6005, AA6005A, AA5005, AA5005A, AA5754, AA5051A, AA5052, AA5252, AA5352 AA5018, AA4045 or AA7072.

After joining, e.g. after hemming or pressure-joining via clinching or riveting, the joined structure can be subjected to an artificial ageing heat-treatment, such heat-treatment could eliminated or at least reduce for example susceptibility to delayed fracture. Such a heat-treatment would be carried out at a temperature in the range of 50° C. to 250° C. Such a heat-treatment could be carried out as a one-step ageing treatment or as a multi-step ageing treatment, for example a 2-step or a 3-step ageing treatment. A preferred upper-limit for the heat-treatment is about 210° C. and more preferably about 185° C. A too high temperature may give raise to an adverse effect on the strength levels of AA7000-series aluminium alloys after the paint bake cycle. A preferred lower-limit for the heat-treatment is about 70° C. and more preferably about 100° C.

The heat-treatment in the defined temperature range is preferably carried out such that the joined structure is at the pre-ageing temperature for not longer than 5 hours to avoid a reduction in productivity, and more preferably not longer than about 1 hour. The minimum time is about 1 minute. Typically the heat-treatment is carried out at said temperature for several minutes, e.g. 2 to 30 minutes, such as about 4 or 8 minutes.

Alternatively such an artificial ageing heat-treatment may also coincide with the paint-bake cycle. Following the joining operation, e.g. after hemming or pressure-joining via clinching or riveting, the joined components are typically made part of an assembly of other metal components as is regular in the art for manufacturing vehicle components, and subjected to a paint bake operation to cure any paint or lacquer layer applied. During the paint bake cycle the AA7000-series alloy used in the joined components achieves its desired final strength levels. The paint bake operation or paint bake cycle typically comprises one or more sequential short heat treatments in the range of 120° C. to 200° C. for a period of 10 to less than 40 minutes, and typically of less than 30 minutes. A typical paint bake cycle would comprise a first heat treatment of about 180° C@20 minutes, cooling to ambient temperature, then about 160° C@20 minutes and cooling to ambient temperature. In dependence of the OEM such a paint bake cycle may comprise of 2 to even up to 5 sequential steps and includes drying steps, but either way the cumulated time at elevated temperature (100° C. to 200° C.) of the aluminium alloy product is less than 120 minutes.

In a further aspect of the invention the method is used to manufacture an automotive structural part or member, and preferably a structural part selected from the group of: a door beam, roof beam, side beam, instrumental panel support beam, pillar reinforcement, tunnel, B-pillar (reinforcement) and fire wall.

In a further aspect of the invention it relates to the use of a metal work piece made from an AA7000-series aluminium sheet material, and having a preferred alloy composition as herein described, having been heat-treated at least in a joining area for up to 60 seconds at 100° C. to 350° C. up to 120 minutes prior to the production of a joint and/or for at least part of the time during production of a mechanical joint by joining it to another metal work piece, in particular using a clinch or a rivet.

Figure 2:
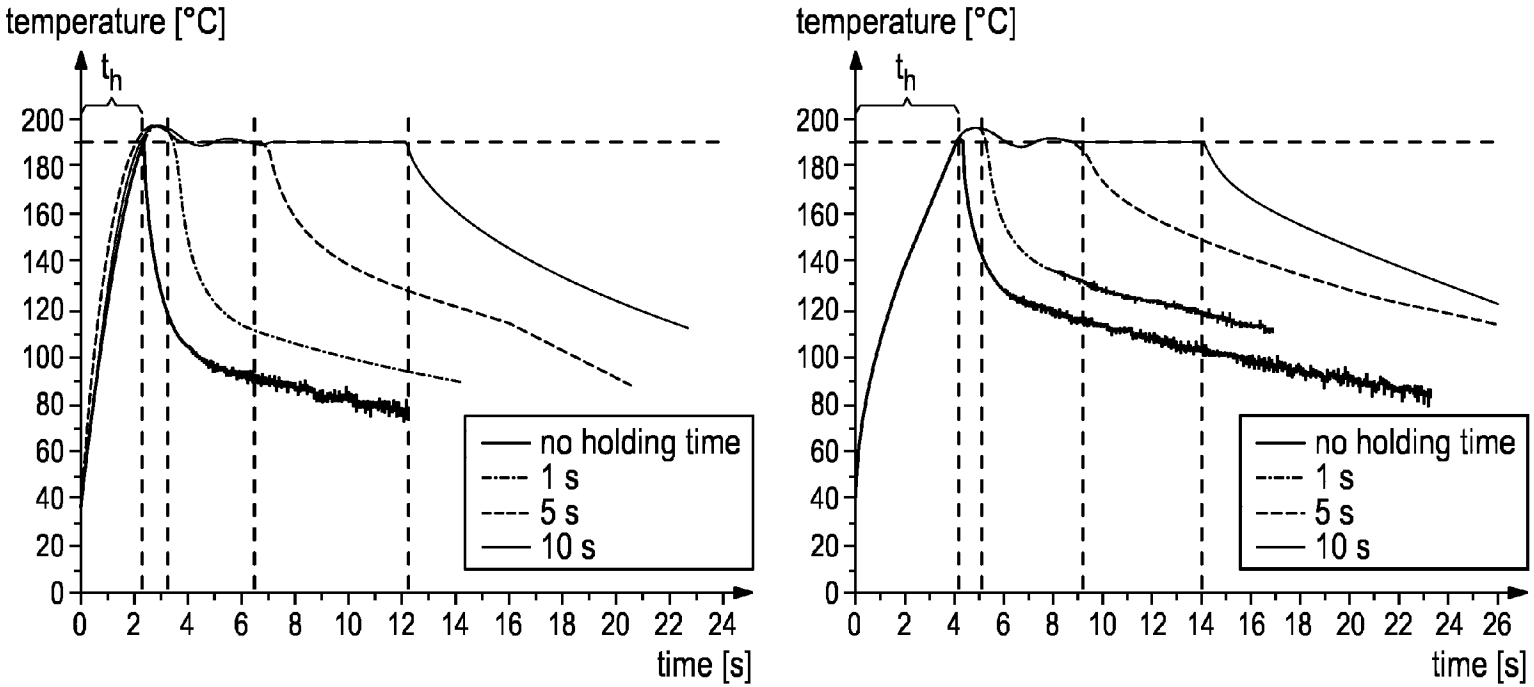
Figure 3:
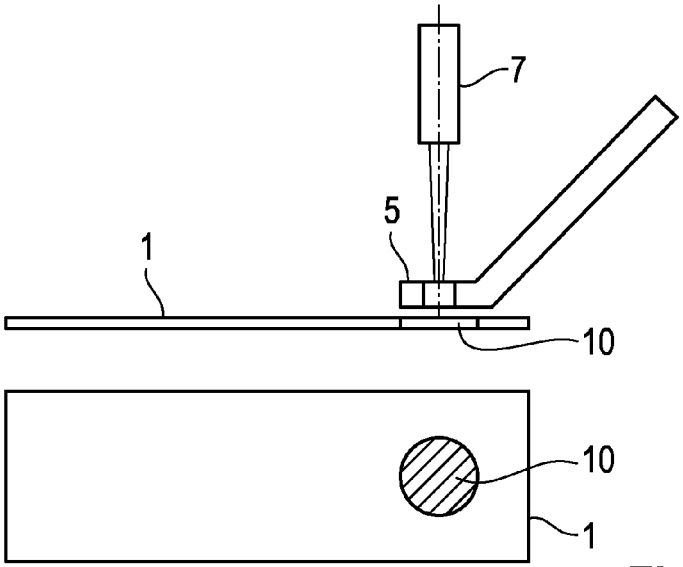
Figure 4:
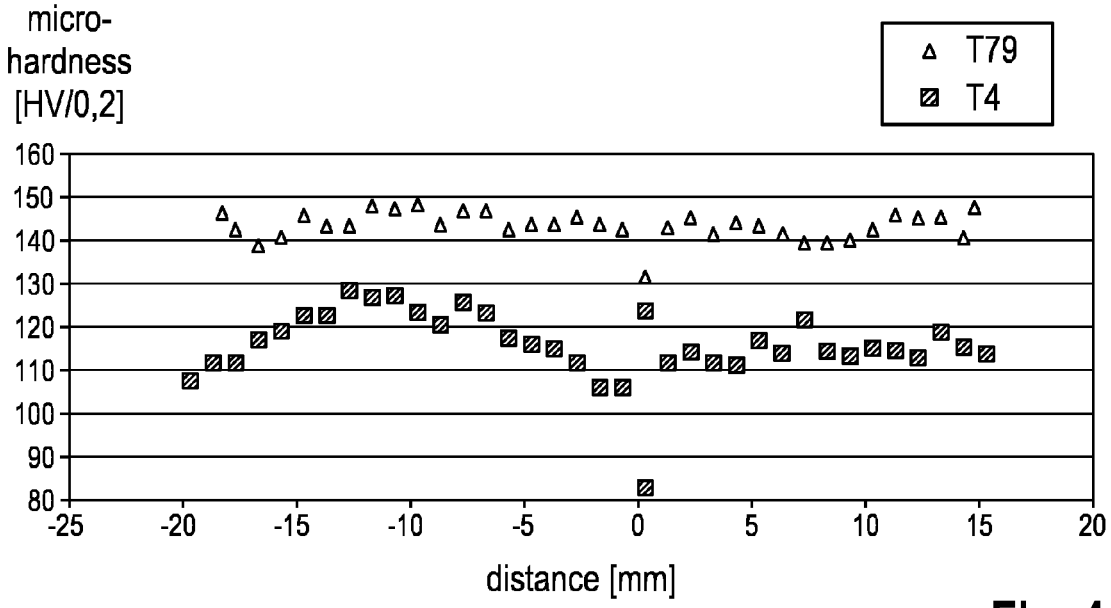
Figure 5:
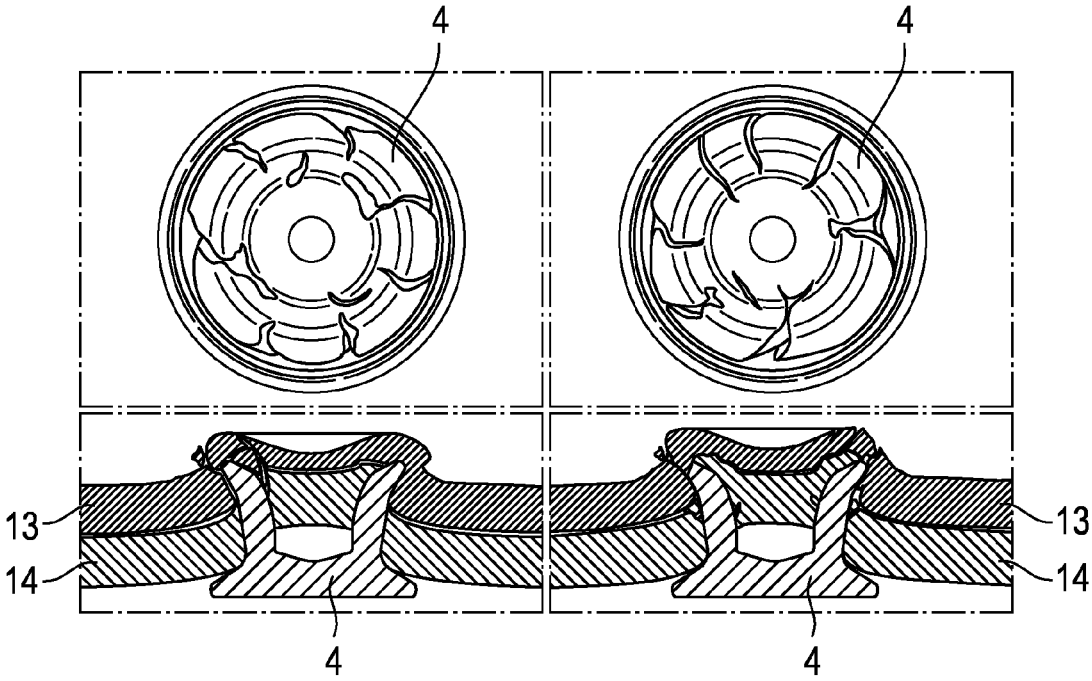
Figure 5:
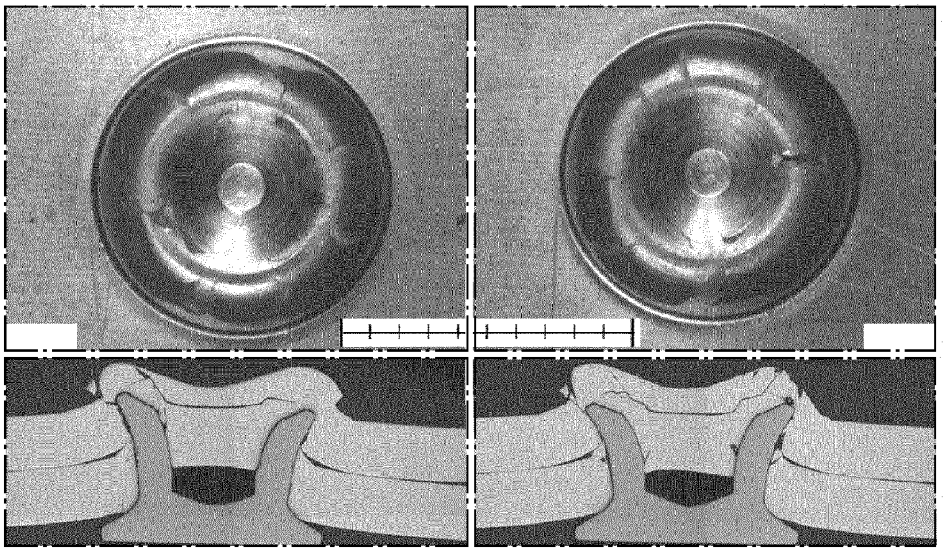
Figure 6:
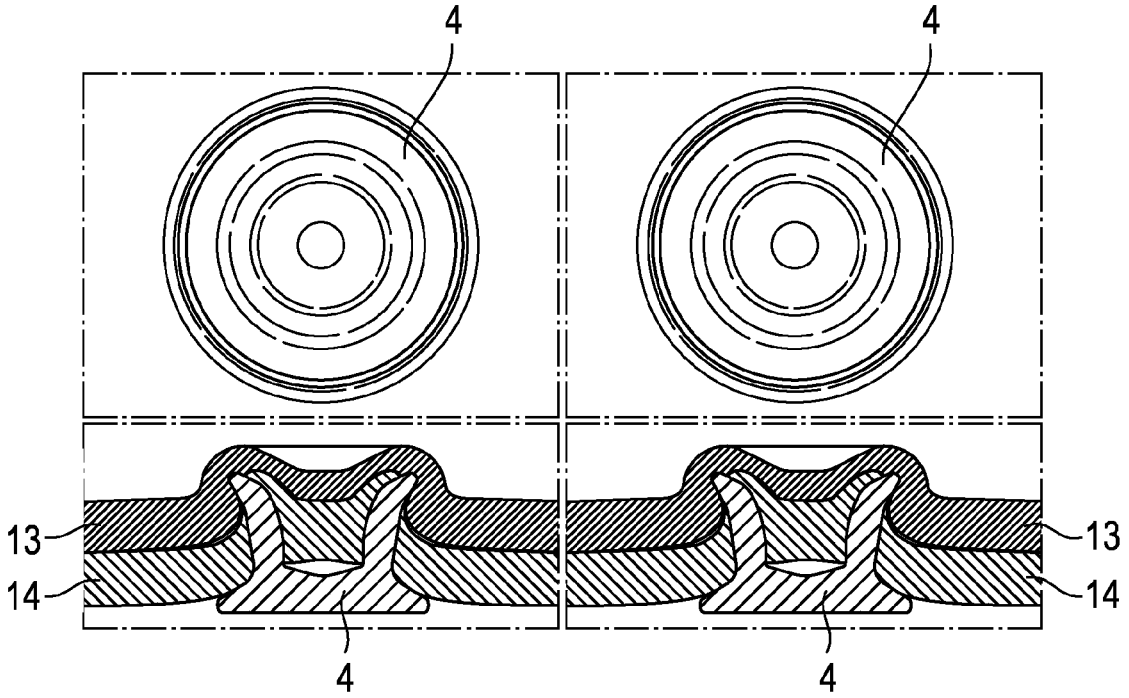
Figure 6:
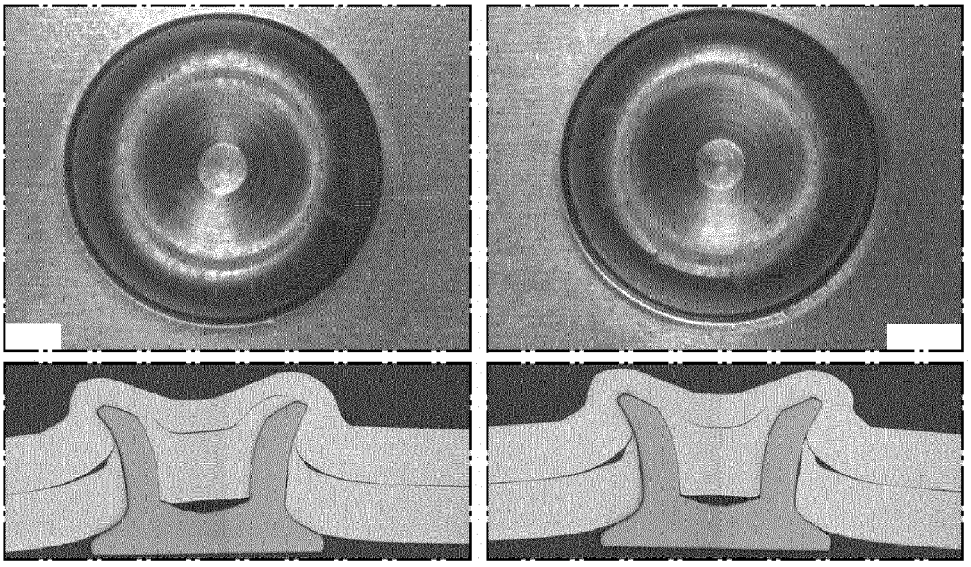
Figure 7:
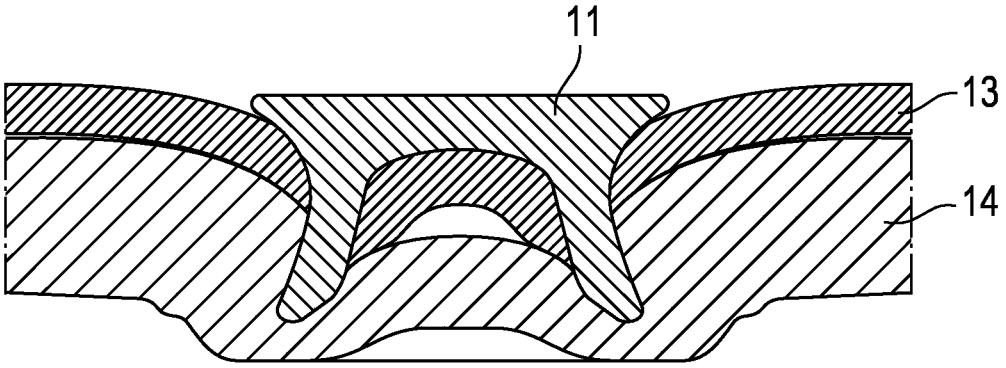
Figure 7:
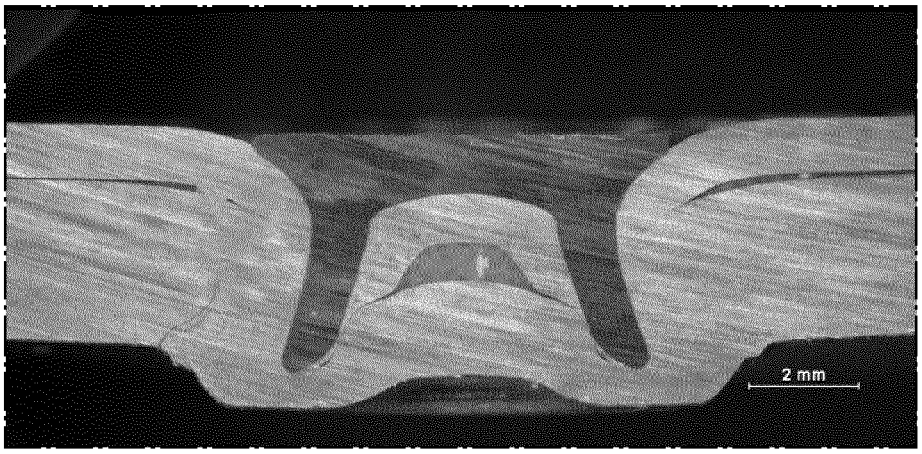
Figure 8:
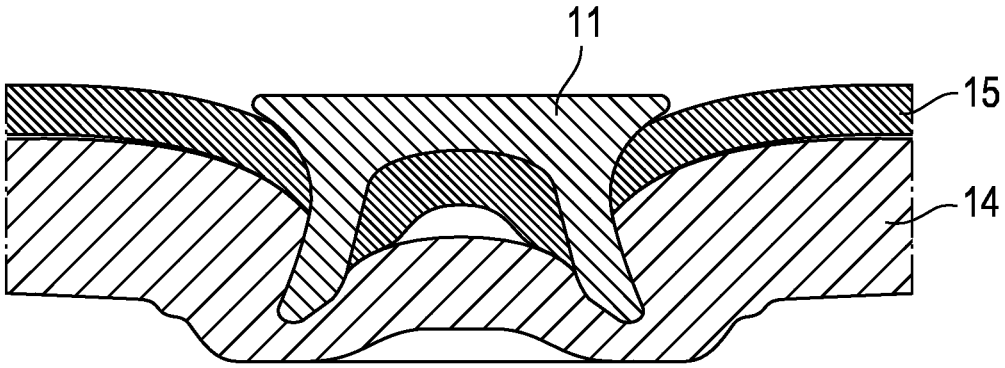
Figure 8:
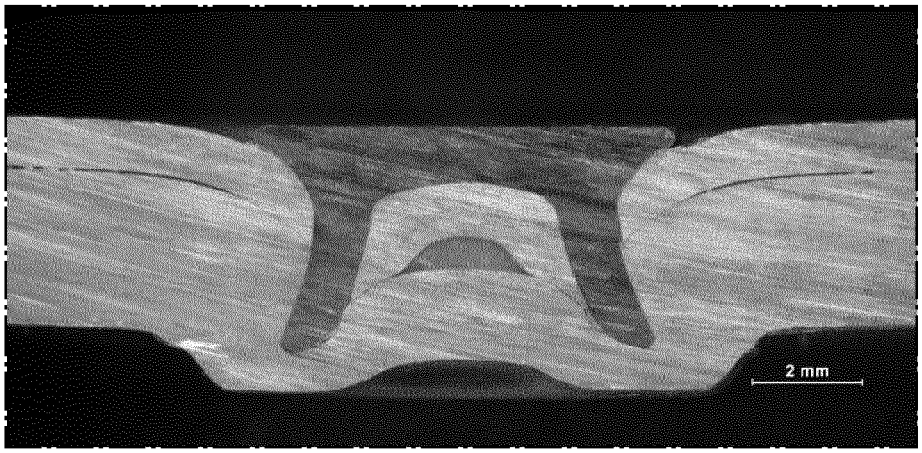
Figure 9:
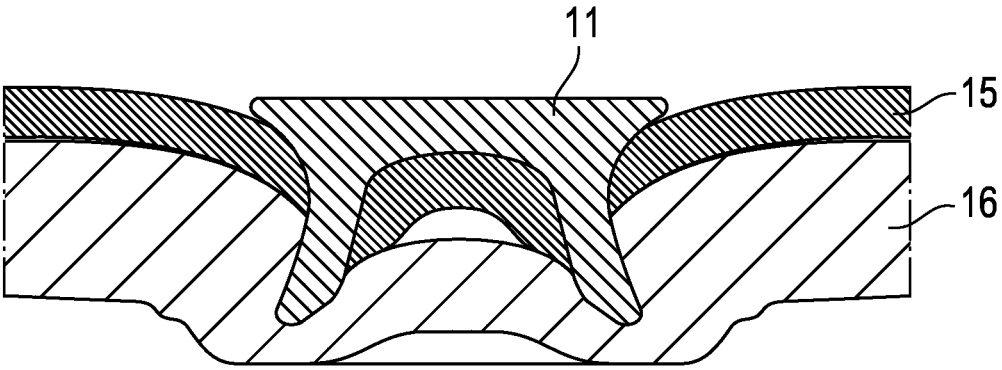
Figure 9:
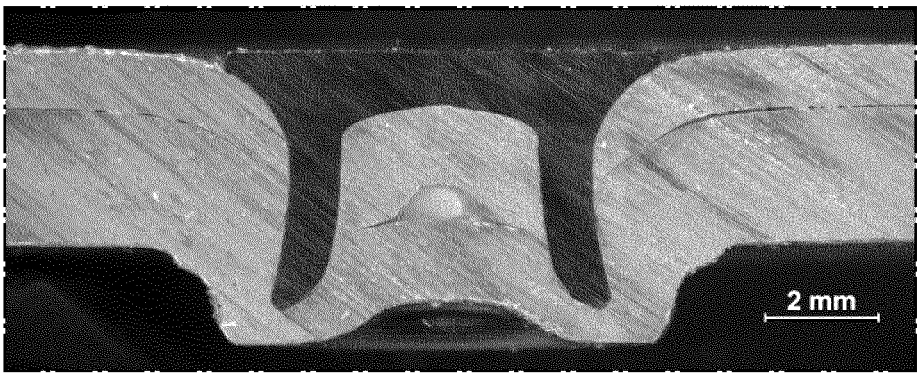
Figure 10:
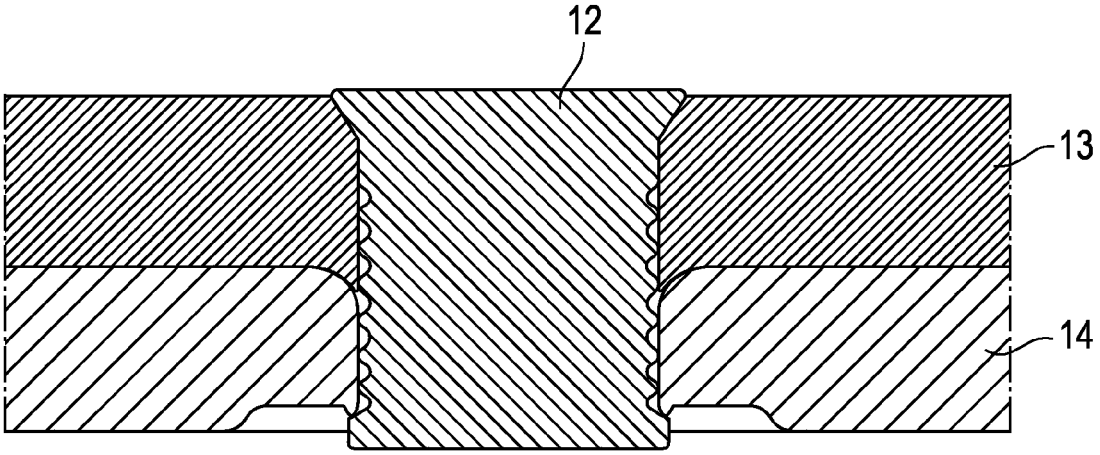
Figure 10:
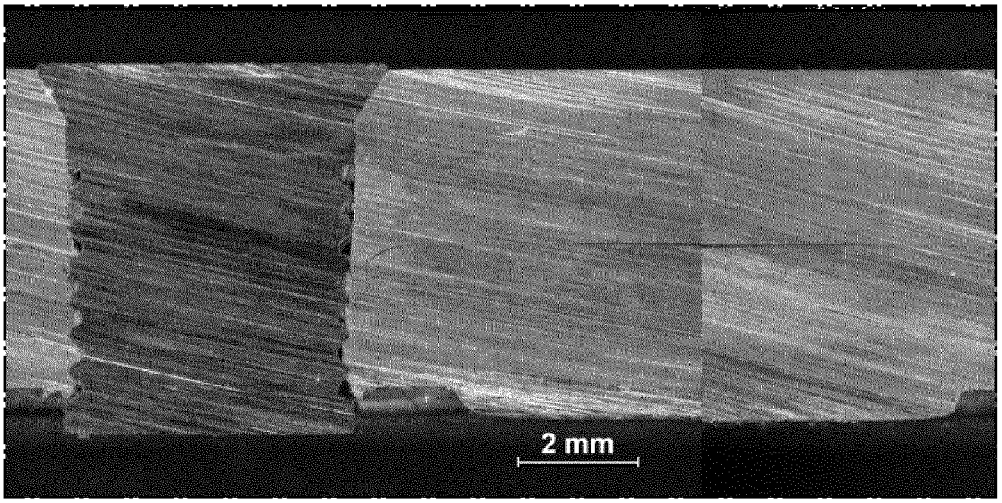

The invention will now be described by means of preferred embodiments and examples with reference to the attached drawings, in which:

FIG. 1: shows a schematic drawing of a method according to an embodiment of the invention;

FIG. 2: shows time-versus-temperature curves in the work pieces during the heat treatment;

FIG. 3: is a schematic drawing of a possible induction heat-treatment apparatus;

FIG. 4: shows a graph of hardness measurements (HV) at various positions in an AA7000-series aluminium alloy sheet starting from the centre of a local heat treatment over the heat affected zone into a not heat treated part of the sheet;

FIG. 5: shows a riveted joint of two AA7000-series aluminium alloy sheets 13, 14 having been riveted in T4-temper (rivet 4) in top view and side view (cross section);

FIG. 6: shows a riveted joint of two AA7000-series aluminium alloys sheets 13, 14 having been riveted after submitting a T4-temper sheet to 180° C. for 10 seconds (rivet 4) in top view and side view (cross section);

FIG. 7: shows a riveted joint of two AA7000-series aluminium alloys sheets 13, 14 of thickness 1 mm and 3 mm respectively, using a rivet C5×5H4 11, a punch force of 55 kN with applying adhesive between both sheets before riveting;

FIG. 8: shows a riveted joint of a AA6016-alloy sheet (thickness=1.0 mm) 15 in an AA7000 series aluminium alloy sheet (thickness=3.0 mm) 14. The rivet 11 and punch force was the same as in FIG. 7, and again adhesive bonding was used in addition;

FIG. 9: shows a riveted joint of a AA6016 alloy sheet (thickness 1.0 mm) 15 into a sheet of AA7081 alloy (thickness 2.0 mm) 16, using a rivet C5×5H4 11, punch force 47 kN and adhesive;

FIG. 10: a riveted joined between two AA7000-series aluminium alloys sheets 13, 14, each thickness 3.0 mm, using a solid rivet 5×6.3 12, punch force 50 kN and adhesive.

FIG. 1 shows a sequence of steps forming part of an embodiment of the invention. In step A, the original work pieces or blanks 1, 1' are provided in T4x or W-temper. In order to submit it to a contact heat-treatment, part of it is disposed between two hot plates 2, 3 heated to 180° C. In the next step B, a short local heat-treatment is carried out by the hot plates 2, 3 contacting the blank. In step C, the blank is cooled on air to room temperature. In step D, a rivet 4 is used to produce a mechanical join between blank 1 and another sheet within a limited time after the previous heating and cooling.

Another preferred set-up for providing the heat-treatment is shown in FIG. 3: Therein, an induction coil 5 is placed above a specific area of the blank or work piece 1. The inductor coil has for example an inner diameter of 10 mm and an outer diameter of 15 mm. The temperature is measured and controlled by a (infrared) pyrometer 7. This heat-treatment results in a heat-treated and thereby softened zone 10 of a diameter of about 15 mm, i. e. of the outer diameter of the inductor coil, within the work piece 1. Within this zone, a clinch or riveted joint can be produced within 120 minutes after applying the local heat treatment.

FIG. 2 shows typical temperature-versus-time curves within the heat-treated zone 10 achievable with an induction heating set-up such as shown in FIG. 3. The left graph has been taken on a sheet of 2 mm thickness, the right graph on a sheet of 3 mm thickness. As one may see, the sheet of gauge 2 mm needed a heat-up time $t_h$ of about 2 seconds, whereas the 3 mm sheet needed about 4 seconds to heat up. The holding time varied between practically 0, 1 sec., 5 and 10 sec. All holding times proved to produce good results, even the holding time of practically 0. Thus, it is concluded that very short heat treatments are sufficient.

FIG. 4 shows a graph of hardness in HV at various positions in an AA7000-series aluminium alloy sheet starting from an area that was subjected to a local heat treatment (position 0 to 20 mm) over the heat affected zone (position 0 to −10 mm) into a not heat treated part of the sheet (position −10 to −20 mm). As can be seen from this graph, the strength after a T79 aging treatment is on all positions on the same level proving that the short local heat treatment at 180° C. for 5 seconds (local reversion anneal treatment) has no negative effect on the final strength.

The following examples are provided to further illustrate the objectives and advantages of this invention. It is not intended to limit the scope of this invention in any manner, however.

EXAMPLE 1

Two sheets, each of 2 mm gauge and made of AA7000-series aluminium alloys, were produced by casting an alloy of the AA7000 series having the following composition (in wt. %): 6.4 Zn, 1.9 Mg, 0.14 Zr, 0.15 Fe and 0.1 Si, remainder aluminium and incidental impurities. The cast ingot was homogenised, scalped, hot-rolled, cold-rolled to the final gauge and finally solution heat treated to T4 temper. The sheets were joined via SPR joints using two commercially available riveting techniques.

In the first trial both sheets were in a T4 condition (solution heat-treated, quenched, and natural aged for over 6 months) and pictures of the resultant joint are shown in FIG. 5. From the pictures of FIG. 5 it is clear that there is undesirable formation of cracks in the sheet material.

In a second trial the same sheets in the T4 condition have been heat-treated for 10 sec. at 180° C., cooled on air to RT and then within about 5 minutes after cooling joined using the two SPR techniques. From the pictures of FIG. 6 the benefit of the heat-treatment is clear and no formation of cracks occur in the sheet material, and whereby a sound and reproducible SPR joint is being formed.

In this experimental set up the complete sheets have been heat-treated, but it will be immediately apparent to the skilled person that the same effect will be obtained when the heat-treatment is carried out locally in the joining area.

EXAMPLE 2

Similar tests as in example 1 have been done with various other sheets. The sheet composition, rivet type, punch force etc. is listed in the below table 2. Before riveting, the T4-temper sheet had undergone a heat-treatment of 190° C. for between 1 and 10 seconds, and the rivets were produced within 2 hours from the heat-treatment. The resulting riveted joints shown in FIGS. 7-10 show that there was no formation of cracks, and a sound and reproducible joint is formed in each case.

| | FIG. 7 | FIG. 8 | FIG. 9 | FIG. 10 |
|---|---|---|---|---|
| Top sheet composition | AA7021 type | AA6016 | AA6016 | AA7021 type |
| Top sheet thickness | 1 mm | 1 mm | 1 mm | 3 mm |
| Bottom sheet composition | AA7021 type | AA7021 type | AA7081 | AA7021 type |
| Bottom sheet thickness | 3 mm | 3 mm | 2 mm | 3 mm |
| Rivet | C5x5H4 | C5x5H4 | C5x5H4 | 5x6.3 |
| Punch force | 55 kN | 55 kN | 47 kN | 50 kN |
| Adhesive: Betamate | yes | yes | yes | yes |

While various embodiments of the technology described herein have been described in detail, it is apparent that modifications and adaptations of those embodiments will occur to those skilled in the art. However, it is to be expressly understood that such modifications and adaptations are within the spirit and scope of the presently disclosed technology.

The invention claimed is:

1. A method for producing a joint in at least two overlapping metal work pieces using a joining tool to obtain a mechanical joint between the overlapping work pieces, wherein at least one of the first work piece and second work piece is a sheet material made of an aluminium alloy of AA7000-series, and wherein there is applied a heat-treatment with a temperature in the range of 100° C.-230° C. to at least the work piece of said 7000-series sheet material within 120 minutes prior to the production of the joint and/or for at least part of the time during production of the joint to reduce the tensile strength in the joining area of at least the work piece of said 7000-series sheet material.

2. The method according to claim 1, wherein the heat-treatment of said 7000-series sheet material involves heating to the temperature in the range of 100° C. to 230° C. for a period of up to 60 seconds.

3. The method according to claim 1, wherein the heat-treatment of said 7000-series sheet material is performed within 120 minutes prior to the production of the joint.

4. A method according to claim 1, wherein the heat-treatment of said 7000-series sheet material is performed at least part of the time during production of the joint.

5. The method according to claim 1, wherein the AA7000-series alloy is selected from the group consisting of AA7021, AA7136, AA7075, AA7081, AA7181, AA7085, AA7185, AA7050, AA7150,and AA7055.

6. The method according to claim 1, wherein the AA7000-series alloy has a composition of, in wt. %, Zn 3.8 to 8.2,
Mg 1.5 to 2.3,
Cu 0 to 0.45,
Zr 0.04 to 0.25,
optionally one or two elements selected from the group consisting of
Mn 0.05 to 0.5,
Cr 0.05 to 0.5,
Ti 0 to 0.15,
Fe 0 to 0.35,
Si 0 to 0.25,
other elements and unavoidable impurities, each maximum 0.05, total 0.20, balance aluminium.

7. The method according to claim 1, wherein the AA7000-series alloy has a composition of, in wt. %, Zn 3.8 to 8.2,
Mg 1.5 to 2.3,
Cu 0.6 to 2.4,
Zr 0.04 to 0.25,
optionally one or two elements selected from the group consisting of:
Mn 0.05 to 0.50,
Cr 0.05 to 0.5,
Ti max. 0.15,
Fe max. 0.35,
Si max. 0.25,
other elements and unavoidable impurities, each maximum 0.05, total 0.20, balance aluminium.

8. The method according to claim 1, wherein the mechanical joint is obtained by means of pressure-joining.

9. The method according to claim 8, wherein the mechanical joint is obtained by clinching.

10. The method according to claim 8, further using the joining tool, the joining tool comprising a punch to insert a rivet into the work pieces to form the joint, the work pieces having a first surface that is nearest the tool, the method comprising:

placing the work pieces between the tool and a die, and positioning a rivet between the punch and the first surface, using the punch to insert the rivet into the at least two overlapping work pieces such that the first surface is pierced by the rivet.

11. The method for producing a joint according to claim 8 of at least two overlapping metal work pieces using the joining tool, the joining tool comprising a punch to insert a self-piecing rivet into the work pieces to form the joint, the work pieces having a first surface that is nearest the tool, the method comprising:

placing the work pieces between the tool and a die, and positioning a rivet between the punch and the first surface, using the punch to insert the rivet into the at least two overlapping work pieces such that the first surface is pierced by the rivet, and wherein at least one of the first work piece and second work piece is the sheet material made of the aluminium alloy of the AA7000-series, and wherein there is applied the heat-treatment to at least the work piece of said 7000-series sheet material within 120 minutes prior to the production of the joint and/or for at least part of the time during production of the joint to temporarily reduce the tensile strength in the joining area of at least of the work piece of said 7000-series sheet material.

12. The method according to claim 1, wherein the mechanical joint is obtained by hemming.

13. The method according to claim 1, wherein the joint of the at least two overlapping metal work pieces is further artificially aged.

14. The method according to claim 1, wherein the joint forms part of an automotive structural member.

15. The method according to claim 1, wherein the heat-treatment of said 7000-series sheet material is applied only to a specific area of the work piece, where the joint is to be produced.

16. The method according to claim 1, wherein the heat-treatment of said 7000-series sheet material involves heating to temperature in a range of 140° C. to 230° C.

17. The method according to claim 1, wherein the heat-treatment of said 7000-series sheet material involves heating to temperature in the range of 100° C. to 230° C. for a period of up to 30 seconds.

18. The method according to claim 1, wherein the heat-treatment of said 7000-series sheet material is performed within 60 minutes prior to the production of the joint.

19. The method according to claim 1, wherein the AA7000-series alloy has a composition of, in wt.%, Zn 5.0 to 7.0,
Mg 1.5 to 2.1
Cu 0 to 0.3,
Zr 0.04 to 0.25,
optionally one or two elements selected from the group consisting of
Mn 0.05 to 0.50,
Cr 0.05 to 0.5,
Ti max. 0.15,
Fe max. 0.35,
Si max. 0.25,
other elements and unavoidable impurities, each maximum 0.05, total 0.20, balance aluminium.

20. The method according to claim 1, wherein the AA7000-series alloy has a composition of, in wt. %, Zn 5.0 to 7.0,
Mg 1.5 to 2.1,
Cu 1.2 to 2.4,
Zr 0.04 to 0.25,
optionally one or two elements selected from the group consisting of:
Mn 0.05 to 0.50,
Cr 0.05 to 0.5,
Ti max. 0.15,
Fe max. 0.35,
Si max. 0.25,
other elements and unavoidable impurities, each maximum 0.05, total 0.20, balance aluminium.

21. The method according to claim 1, wherein the joining comprises mechanical folding or pressure-joining.

22. The method according to claim 1, wherein the heat-treatment of said 7000-series sheet material involves heating to the temperature in the range of 100° C. to 230° C. for a period of up to 20 seconds.

23. The method according to claim 1, wherein the heat-treatment of said 7000-series sheet material involves heating to the temperature in the range of 100° C. to 230° C. for a period of up to 12 seconds.

24. The method according to claim 1, wherein the heat-treatment of said 7000-series sheet material involves heating to temperature in a range of 160° C. to 230° C.

25. The method according to claim 1, wherein the heat-treatment of said 7000-series sheet material involves heating to temperature in a range of 175° C. to 220° C.

* * * * *